US006606474B2

(12) United States Patent
Sirejacob

(10) Patent No.: US 6,606,474 B2
(45) Date of Patent: Aug. 12, 2003

(54) DOCTOR BLADE, TONER CARTRIDGE USING SUCH A DOCTOR BLADE AND COPYING PROCESS

(75) Inventor: Gino Sirejacob, Evergem (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 09/943,580

(22) Filed: Aug. 30, 2001

(65) Prior Publication Data

US 2002/0041777 A1 Apr. 11, 2002

Related U.S. Application Data

(63) Continuation-in-part of application No. PCT/BE00/00104, filed on Sep. 13, 2000, which is a continuation-in-part of application No. 09/394,841, filed on Sep. 13, 1999.

(51) Int. Cl.[7] ..... G03G 15/09

(52) U.S. Cl. ..... 399/274; 399/284

(58) Field of Search ..... 118/261; 399/264, 399/273, 274, 275, 283, 284, 285, 286

(56) References Cited

U.S. PATENT DOCUMENTS

| | | | | |
|---|---|---|---|---|
| 3,830,656 | A | 8/1974 | Takenaka et al. | 117/212 |
| 3,933,548 | A | 1/1976 | Anderson, Jr. et al. | 156/78 |
| 5,089,330 | A | 2/1992 | Sato et al. | 428/323 |
| 6,253,052 | B1 | 6/2001 | Cornelius et al. | 399/274 |
| 6,258,918 | B1 | 7/2001 | Ho et al. | 528/66 |

FOREIGN PATENT DOCUMENTS

| | | | |
|---|---|---|---|
| EP | 337 228 A1 | 4/1989 | C08K/3/04 |
| EP | 786 422 A2 | 1/1997 | B65D/90/46 |

*Primary Examiner*—Hoang Ngo
(74) *Attorney, Agent, or Firm*—Darby & Darby

(57) ABSTRACT

The doctor blade consists of at least a substrate provided with an element having a face adapted for working with a magnetic roller, the element being made at least partly of an elastic material, wherein the face adapted for working with a magnetic roller has an abrasion resistance of less than 0.5 g (measured according to the method ASTM D4060).

69 Claims, 7 Drawing Sheets

DOCTOR BLADE, TONER CARTRIDGE USING SUCH A DOCTOR BLADE AND COPYING PROCESS

This application is a continuation in part of PCT/BE 00/00104 filed on Sep. 13, 2000, claiming the priority of U.S. Ser. No. 09/394,841 filed on Sep. 13, 1999.

This application claims priority from PCT/BE00/000104 having an international filing date of Sep. 13, 2000 and U.S. patent application Ser. No. 09/394,841 filed Sep. 13, 1999.

THE STATE OF THE ART

The doctor blade is used in a toner cartridge assembly for ensuring a substantially even distribution of toner on a magnetic roller.

It has been observed that during the use of a toner cartridge assembly, the efficiency of the doctor blade decreases, whereby the quality of copying and or printing documents decreases.

This problem is especially important when toner cartridge assembly are reconditioned for use.

It has been proposed to apply on the doctor blade a strip comprising a polyurethane conductive layer and a polyester layer, the said strip having a total thickness of about 30–60 μm. The polyester layer is glued on the doctor blade.

However, after 2,000–3,000 copies, the efficiency of such a doctor blade starts to decrease, whereby the quality of the following copies is poor. An adhesive conductive strip to be attached to a doctor blade of an electrostatic printing assembly is disclosed in U.S. Pat. No. 6,253,052.

The invention relates to a doctor blade with an improved efficiency, as well as a strip to be glued on a substrate of a doctor blade for improving its efficiency.

BRIEF DESCRIPTION OF THE INVENTION

The invention relates to a doctor blade consisting of at least a substrate provided with an element having a face adapted for working with a magnetic roller of a machine selected from the group consisting of copier, printer and facsimile machine, said element being made at least partly of an elastic material. In the PCT application PCT/BE 00/00104, at least a part of the face adapted for working with a magnetic roller has an electrical surface resistivity of less than $10^{13}$ Ω per square, preferably between $10^7$ and $10^{12}$ Ω per square, while at least a part of the element made at least partly of an elastic material has a thickness of at least 100 μm, for example comprised between 100 μm and 5 mm. Said face contacts the magnetic roller with interposition of toner particles. According to an example of said application, the layer contacting the developer roller has an abrasion resistance of less than 0.1 g.

It has now been discovered that an excellent working of the doctor blade seems more to be due to abrasion resistance and uniform density of the face contacting the developer roller, than due to the surface resistivity of said top face. When using a top coating applied directly on the substrate, said coating forms after drying or curing an uniform layer, i.e. a layer with uniform density or characteristics or properties at least at the top surface or contact surface (surface intended to contact the magnetic roller with interposition of toner particles).

When using a strip, it is of importance that the top face intended to contact the magnetic roller has uniform characteristics, such as uniform density, continuous outer elastic or elastomer film, together with good abrasion resistance, so as to obtain consistent triboelectric charge and consistent printing.

When using such a strip, it is advantageous to provide said strip with a coating having constant or uniform characteristics, said coating forming a continuous film or substantially continuous film. The coating is advantageously prepared from an elastomer material, for example from a dispersion containing polyurethane, such as an aqueous dispersion containing polyurethane. Tests made by attaching a polyurethane strip with a shore A hardness of 95 on a doctor blade, strip not provided with a coating for obtaining said continuous and uniform top face, have shown bad printing results. It seems that this bad printing is due to the absence of uniform density of the top face, whereby the abrasion of the top face due to the contact with the magnetic roller was not uniform, and varied form place to place. It shows therefore the importance to have an uniform and continuous top face or coating with good wear resistance for obtaining excellent printing for a long time.

The invention relates thus to a doctor blade comprising at least a flexible element with an outer face, a portion of said outer face being adapted for contacting with interposition of toner particles a magnetic roller of a machine selected from the group consisting of copier, printer and facsimile machine, in which said portion is provided with a coating (advantageously a flexible coating, such as an elastomer coating) or with a strip (advantageously a flexible strip, such as a flexible strip provided with a coating, preferably a flexible coating), said coating or strip having an abrasion resistance measured by the ASTM-D4060 abrasion test of less than 0.5 g, advantageously less than 0.2 g, preferably less than 0.1 g, most preferably less than 0.01 g or even lesser.

The abrasion test ASTM-D4060 to which reference is made in the present specification is a taber abrader test (weight loss measurement), abrasion obtained after 1000 cycli with a load of 1,000 g, using an abrader wheel CS10.

The doctor blade comprises advantageously at least a flexible substrate provided with a flexible strip having a top face, a portion of which is adapted for contacting with interposition of toner particles a magnetic roller of a machine selected from the group consisting of copier, printer and facsimile machine, in which said portion is provided with a coating or strip having an abrasion resistance measured by the ASTM-D4060 abrasion test of less than 0.5 g, advantageously less than 0.2 g, preferably less than 0.1 g, most preferably less than 0.01 g or even lesser. The top face is advantageously uniform or substantially uniform, i.e. has a uniform or substantially uniform top density.

According to an embodiment, the coating or strip (advantageously flexible coating, flexible strip or strip provided with a flexible coating) has a thickness (adhesive included) of at least 75 μm (advantageously more than 100 μm, for example comprised between 150 μm and 5 mm, preferably between 200 μm and 3 mm, most preferably between 200 μm and 2 mm) measured at the level of the portion contacting the magnetic roller with interposition of toner particles.

For example, at least the portion of the coating or strip (advantageously flexible coating, flexible strip or strip provided with a flexible coating) contacting the magnetic roller with interposition of toner particles has a surface resistivity of more than $10^2$ ohms per square.

In an advantageous embodiment, at least the portion of the coating or strip (advantageously flexible coating, flexible strip or strip provided with a flexible coating) contacting the magnetic roller with interposition of toner particles has a surface resistivity of more than $10^7$ ohms per square, preferably more than 1.5 $10^{12}$ ohms per square, most preferably more than $10^{13}$ ohms per square, such as 0.5 $10^{14}$ and $10^{18}$ ohms per square.

The coating or strip (advantageously flexible coating, flexible strip or strip provided with a flexible coating) is for example at least partly made of elastomer material, said material being advantageously selected among the group consisting of polyurethane, rubber, silicone, fluoropolymers or copolymers, polyacrylate, polymethacrylate, copolymer of acrylic and methacrylic acids, polyolefins, polypropylene, polyethylene, and mixtures thereof. In case the strip has to be conductive, conductive polymers or copolymers has to be used.

The substrate of the doctor blade is for example a substrate made at least partly of a material selected from the group consisting of polyurethane, silicone, polyester, metallic blade, PVC, polycarbonate, fluoropolymers or copolymers, polyacrylate, polymethacrylate, copolymer of acrylic and methacrylic acids, polyolefins, polypropylene, polyethylene, and mixtures thereof, said flexible strip being attached to said substrate According to a detail of an embodiment, the flexible substrate has a free end edge, said free end edge being at least partly covered by said strip or flexible strip.

According to an advantageous detail, the strip or flexible strip is glued on the flexible substrate. For example a face of the strip is provided with a glue layer so as to facilitate the placement of the strip on the doctor blade.

According to another embodiment, the strip or flexible strip has a first portion covering at least a part of the substrate and a second portion forming an extension of the substrate from its free end edge.

According to a preferred embodiment, the coating or strip (advantageously flexible coating, flexible strip or strip provided with a flexible coating) has a Shore A hardness of less than 105, preferably less than 100, most preferably less than 96, possibly less than 94, for example less than 92. Strip with a Shore A hardness of more than 100, in some case of more than 96, are often considered as being too rigid.

According to advantageous details of embodiments of the invention, the coating or strip (advantageously flexible coating, flexible strip or strip provided with a flexible coating) has at least one characteristic (advantageously more than one, preferably all the following characteristics) selected in the group consisting of flexural modulus of $10^8$ Pa or less (flexibility of the strip under tortional strain), a storage modulus of $10^8$ Pa or less (i.e. a sufficient rigidity of the strip under tension), a Shore A hardness of less than 105, a Hoffman scratch-hardness test result of 2 or less (an abrasion resistance), and a color shift, in accordance with heat aging test ASTM D2244-79, within 1 delta E.

The methods of measurement of these characteristics are disclosed in U.S. Pat. No. 6,258,918 (Ho et al) having for subject matter a flexible polyurethane material, the content of said document is incorporated to this specification by reference.

The color shift is not an important parameter, as the polyurethane can be not transparent and can be discoloured due to aging, without modification of abrasion resistance.

Advantageously, the flexible substrate is provided with a longitudinal means for facilitating its bending in a direction with respect to the opposite direction. For example, the flexible substrate comprises a first portion adapted to be connected to a support, a second portion with a free end edge and adapted to contact the developer roller with interposition of the flexible strip, and an intermediate bending portion connecting the first and second portions. The strip can be attached to the substrate so as to cover partly the bending portion or so as to not cover the bending portion.

The thickness of the strip and the mechanical/physical properties of the top layer of the strip or coating (layer contacting the magnetic roller with interposition of toner particles) are advantageously selected so as to ensure the formation of a sufficient triboelectrical charges (electric charges formed due to the friction of the doctor blade on the magnetic roller), whereby ensuring that the toner particles are sufficiently charged by friction so as to ensure a correct transfer of toner particles on the magnetic roller and whereby ensuring good quality of printing.

According to a detail of a possible embodiment, the substrate has a free end edge and in that the coating or strip (advantageously flexible coating, flexible strip or strip provided with a flexible coating) is distant from said free edge of a distance comprised between 25 $\mu$m and 2 mm.

The strip or flexible strip has advantageously a substantially rectangular shape with a variable thickness along its width. Preferably, the flexible strip has a first thickness along an edge adjacent to the free edge of the substrate and a second thickness for a portion distant from said edge, said second thickness being lower than the first thickness.

The strip is advantageously a rigid support or a semi rigid support or a flexible support, said support being provided with a coating having an abrasion resistance of less than 0.5 g. On the opposite face, the support is preferably provided with adhesive, such as a self adhesive layer.

The invention relates also to a toner assembly for a copier, printer or facsimile machine comprising at least:

a container for containing toner;

a magnetic roller, and a doctor blade working with the magnetic roller, the said toner assembly having the improvement that the doctor blade comprises at least a flexible element with an outer face, a portion of said outer face contacting with interposition of toner particles the magnetic roller, in which said portion is provided with a coating having an abrasion resistance measured by the ASTM-D4060 abrasion test of less than 0.5 g, advantageously less than 0.2 g, preferably less than 0.1 g, most preferably less than 0.01 g or even lesser. Said coating contacting the magnetic roller with interposition of toner particles has advantageously one or more of the characteristics listed for the coating or strip (advantageously flexible coating, flexible strip or strip provided with a flexible coating) applied on a doctor blade as disclosed here above in his specification. For example said portion has a flexural modulus of $10^8$ Pa or less (flexibility of the strip under tortional strain) and/or a storage modulus of $10^8$ Pa or less (i.e. a sufficient rigidity of the strip under tension) and/or a Shore A hardness of less than 94 and/or a Hoffman scratch-hardness test result of 2 or less (an abrasion resistance) and/or a color shift, in accordance with heat aging test ASTM D2244-79, within 1 delta E. The surface resistivity can vary for example from $10^2$ to $10^{18}$ ohms per square, advantageously more than $10^7$, preferably more than 1.5 $10^{12}$, most preferably more than $10^{13}$ ohms per square.

The invention further relates to a toner assembly for a copier, printer or facsimile machine comprising at least:

a container for containing toner;

a magnetic roller, and a doctor blade working with the magnetic roller, the said toner assembly having the improvement that the doctor blade comprises at least a flexible substrate provided with a strip (preferably a flexible strip) having a top face, a portion of which is adapted for contacting with interposition of toner particles a magnetic roller of a machine selected from the group consisting of copier, printer and facsimile machine, in which said portion has an abrasion resistance measured by the ASTM-D4060 abrasion test of less than 0.5 g, advantageously less than 0.2 g, preferably less than 0.1 g, most preferably less than 0.01 g or even lesser.

The doctor blade with the strip is advantageously a doctor blade of the invention as disclosed here above in this specification.

In a toner assembly of the invention, the doctor blade is not provided with electrical connecting means for connecting it to a voltage supplying means.

In the toner assembly of the invention using a coating or strip (advantageously flexible coating, flexible strip or strip provided with a flexible coating) attached to the substrate of the doctor blade, the doctor blade comprises at least a substrate having a free end edge and is provided with the coating or strip having a face contacting the magnetic roller with interposition of toner particles, and in which the coating or strip is distant from said free end edge of the substrate of a distance of at least 50 $\mu$m.

The invention relates also to a process for printing or copying a document by means of a printer, copier or facsimile machine, in which at least:

toner is transferred on a magnetic roller;

a doctor blade contacts said magnetic roller with interposition of toner particles for distributing toner on the magnetic roller;

toner distributed by the doctor blade of the magnetic roller is transferred on a charge sensible element, and toner transferred on the charge sensible element is transferred on a support, said process having the improvement that a doctor blade of the invention is used or that a toner cartridge of the invention is used.

For example, the doctor blade comprises:

at least a (possibly flexible) element with an outer face, a portion of said outer face being provided with a coating contacting with interposition of toner particles the magnetic roller, in which said coating has an abrasion resistance measured by the ASTM-4060 abrasion test of less than 0.5 g, preferably less than 0.2 g, most preferably less than 0.1 g, or at least a flexible substrate provided with a strip or flexible strip having a top face, a portion of which is adapted for contacting with interposition of toner particles a magnetic roller of a machine selected from the group consisting of copier, printer and facsimile machine, in which said portion has an abrasion resistance measured by the ASTM-4060 abrasion test of less than 0.5 g, advantageously of less than 0.2 g, preferably less than 0.1 g.

Advantageously, the doctor blade is not provided with electrical connecting means for connecting it to a voltage supplying means.

The invention further relates to;

a process for reconditioning a doctor blade of a printer, copier or facsimile machine, said doctor blade having a flexible substrate, in which, prior to the gluing of a strip or flexible strip with a face having a resistance against abrasion measured by the ASTM-D4060 abrasion test of less than 0.5 g (advantageously less than 0.2 g, preferably less than 0.1 g, most preferably less than 0.01 g or even lesser) on the substrate of the doctor blade or prior the coating of the substrate of the doctor blade with a coating layer having (after drying or curing) a resistance against abrasion measured by the ASTM-D4060 abrasion test of less than 0.5 g (advantageously less than 0.2 g, preferably less than 0.1 g, most preferably less than 0.01 g or even lesser), the substrate having a shape distorted during a prior use thereof is submitted to a heat treatment and to a pressure for restoring substantially the shape of the substrate of the doctor blade before its use, and a process for reconditioning a doctor blade of a printer, copier or facsimile machine, said doctor blade having a flexible substrate, in which, after gluing of a flexible strip with a face having a resistance against abrasion measured by the ASTM-D4060 abrasion test of less than 0.5 g (advantageously less than 0.2 g, preferably less than 0.1 g, most preferably less than 0.01 g or even lesser) on the substrate of the doctor blade or after the coating of the substrate of the doctor blade with a coating layer having (after drying or curing) a resistance against abrasion measured by the ASTM-D4060 abrasion test of less than 0.5 g (advantageously less than 0.2 g, preferably less than 0.1 g, most preferably less than 0.01 g or even lesser), the substrate having a shape distorted during a prior use thereof is submitted to a heat treatment and to a pressure for restoring substantially the shape of the substrate of the doctor blade before its use.

When applying a strip or flexible strip or coating on the substrate of the doctor blade, the substrate is preferably a substrate which has already been used, i.e. in which a longitudinal groove is formed at the contact line of the substrate with the developer roller.

The strip or flexible strip is advantageously glued on the flexible substrate of the doctor blade. Other fixing means of the flexible strip on the flexible substrate are possible, such as mechanical fixing means. In case of mechanical fixing means, the flexible strip is bound to a substantially rigid support (such as an aluminum plate), the longitudinal edges of which slides into rails of the substrate. In case of mechanical fixing means, the strip comprises advantageously a rigid or substantially rigid support provided with a coating with the requested abrasion resistance.

The face adapted for working with the magnetic roller has advantageously a resistance against abrasion measured by the ASTM-D4060 abrasion test of less than 0.5 g, advantageously less than 0.2 g, preferably less than 0.1 g, most preferably less than 0.01 g or even lesser.

Most preferably, not only the skin of the flexible strip or coating has good abrasion resistance, but even at least a part of the matrix or mass of the strip has such a good abrasion resistance. It means that even if the skin would be abraded, the layer just below the skin would still have a sufficient abrasion resistance.

According to another embodiment, the substrate is a flexible substrate having a face on which the strip or flexible strip or coating is attached, the said face of the substrate having a free end edge. The strip is distant from said free end edge advantageously of a distance of at least 50 $\mu$m, preferably of at least 100 $\mu$m, for example of 200 $\mu$m to 600 $\mu$m.

The strip, flexible strip, coating can be a multilayered strip, for example a strip comprising a top layer with a first surface resistivity (for example of more than 1.5 $10^{12}$ ohms per square) and a base layer with another surface resistivity (said layer possibly containing conductive material and having for example a surface resistivity of less than $10^{12}$ ohms per square). Said top layer has for example a thickness of less than 50 μm, for example comprised between 0.1 and 35 μm (such as 0.5 μm, 1 μm, 3 μm, 5 μm, 10 μm, 20 μm, 25 μm), while the base layer or layer have a total thickness advantageously sufficient for having a total thickness of the strip, flexible strip or coating of at least 100 μm.

According to a preferred embodiment, the strip or coating is a mono layer strip or coating.

According to another possible embodiment, the doctor blade comprises a flexible substrate having a free end edge, at least one layer being glued on a face of the substrate at a distance from said free end edge so as to form a groove or recess with a depth of at least 100 μm, preferably of at least 200 μm. Said depth is advantageously comprised between 200 and 600 μm. Said groove has advantageously a width of at least 200 μm, for example comprised between 500 μm and 5 mm, but preferably comprised between 500 μm and 2 mm.

Although the doctor blade can be connected to a voltage supply means, the doctor blade is advantageously not connected to a voltage supply means or not intended to be connected to a voltage supply means (such as a DC power source). When the doctor blade is intended to be connected to a voltage supply means, the strip, flexible strip or coating of the invention can have a conductive layer intended to contact (with interposition of an adhesive layer) a conductive or semiconductive layer or support of the doctor blade.

The invention further relates to a strip for a doctor blade, i.e. a strip to be fixed on a doctor blade, preferably to be glued on the doctor blade, for example by means of hot melt glue. The means for attaching the strip on the substrate is a glue layer, an auto adhesive glue layer or a hot melt glue layer.

Preferably, the top face or layer adapted for working with a magnetic roller has an electrical surface resistivity of more than 1.5 $10^{12}$ Ω per square and a resistance against abrasion measured by the ASTM-D4060 abrasion test of less than 0.5 g, advantageously less than 0.2 g, preferably less than 0.1 g, most preferably less than 0.01 g or even lesser.

According to a specific embodiment, prior to the gluing of the strip on the substrate of the doctor blade or prior to the coating of the substrate with an appropriate coating, the shape of said substrate being distorted during its use, the substrate is submitted to a heat treatment and to a pressure (advantageously with a bending) for restoring substantially the shape of the substrate of the doctor blade as before its use.

According to another possible embodiment, a strip is first glued on the substrate of the doctor blade, for example a polyurethane substrate or the substrate is first coated with an appropriate coating, said substrate having a shape distorted during its prior use. The substrate is thereafter submitted to a heat treatment and to a pressure (advantageously a bending) for restoring substantially the shape of the substrate of the doctor blade before its use.

Advantageously, the substrate is cleaned and/or dried before attaching a strip of the invention or before coating the substrate with the appropriate coating.

The top (conductive, advantageously not conductive) layer contains preferably at least polyurethane, in the form of a polymer or a copolymer or in the form of a mixture with another polymer or copolymer. The first layer is advantageously a thermoplastic layer.

The invention relates also to a doctor blade comprising at least a flexible substrate provided with a flexible strip having a top face, a portion of which is adapted for contacting with interposition of toner particles a magnetic roller of a machine selected from the group consisting of copier, printer and facsimile machine, in which said strip comprises a layer assembly with a first face adapted for contacting the magnetic roller and with a second face opposite to said first face, and a flexible element coated on its opposite faces with an adhesive, whereby one adhesive face of the element is attached to the second face of the layer assembly, while the other face of the element is attached to the flexible substrate by the adhesive. The use of a doable coated element or film or layer or substrate is advantageous for the manufacture of the strip to be attached on the doctor blade, and so as to be sure of the adhesion of the strip on the doctor blade. Delamination of the strip could also be prevented by using such a double coated element.

Advantageously, the flexible element is a film, whereby said film provided with adhesive on its both opposite faces has a thickness comprised between 20 μm and 200 μm, preferably between 50 and 150 μm, most preferably about 100 μm–125 μm. The assembly layer can be a mono layered assembly or a multilayered assembly, said assembly being made of a flexible material, such as polyurethane, silicone, polyester, metallic blade, PVC, polycarbonate, fluoropolymers or copolymers, polyacrylate, polymethacrylate, copolymer of acrylic and methacrylic acids, polyolefins, polypropylene, polyethylene, and mixtures thereof.

The adhesive is advantageously an adhesive of the acrylic or methacrylic family.

Preferably, the first face of the layer assembly has an abrasion resistance measured by the ASTM-D4060 abrasion test of less than 0.5 g, advantageously less than 0.2 g, preferably less than 0.1 g, most preferably less than 0.01 g or even lesser.

The strip of said doctor blade can further have one or more characteristics (such as thickness, surface resistivity, flexibility, storage characteristics, etc.) of the strip of any doctor blades as disclosed before in the present specification.

The invention further relates to a toner cartridge comprising at least a toner container, a magnetic roller, and a doctor blade, in which at least an element selected from the group consisting of the magnetic roller and the doctor blade is provided with at least a layer contacting the toner particles, said layer containing at least one or more lanthanides, salt thereof, lanthanide containing compound, lanthanide oxide, lanthanide hydroxide, etc. As lanthanide, Cerium (most preferably as cerium oxide) is preferred. The layer contains for example cerium oxide, possibly in admixture with one or more other lanthanide and/or with one or more electrically conductive compound, such as carbon particles, copper, silver, etc.

The magnetic roller and/or doctor blade are provided with a layer containing from 0.1% to 65% by weight, advantageously from 0.2 to 20% by weight, preferably from 0.5 to 10% by weight lanthanide or lanthanide containing compounds, preferably cerium (metal, salt, oxide, hydroxide, etc.).

The lanthanide containing layer is for example a layer of a strip adapted to be attached on the doctor blade, for example by means of adhesive, such as an adhesive layer or a glue layer or a hot-melt adhesive, or a layer of a coating applied on the doctor blade or portions thereof.

The lanthanide containing layer can be conductive, semi conductive or non conductive. For example the lanthanide containing layer can have a surface resistivity of more than $10^2$ ohms per square, advantageously more than $10^6$ ohms per square, preferably more than $10^{10}$ ohms per square, most preferably more than $10^{13}$ ohms per square, such as a surface resistivity comprised between $10^{14}$ and $10^{18}$ ohms per square.

The lanthanide containing layer can have a thickness comprised between 1 μm and 10 mm, advantageously from 5 μm up to 3 mm, preferably from 20 μm up to 2 mm, such as 50 μm, 100 μm, 200 μm and 500 μm.

The lanthanide containing layer comprises for example lanthanide compounds or metal or mixtures thereof, as solid particles with a size lower than 100 μm, advantageously lower than 25 μm, preferably lower than 10 μm, such as lower than 3 μm, less than 2 μm, less than 1 μm or even lower (less than 0.5 μm).

The lanthanide containing layer is for example made of a flexible or elastomer material, such as polyurethane, silicone, polyester, metallic blade, PVC, polycarbonate, fluoropolymers or copolymers, polyacrylate, polymethacrylate, copolymer of acrylic and methacrylic acids, polyolefins, polypropylene, polyethylene, epoxy, polyamide, and mixtures thereof.

The face of the layer adapted to contact the toner particles has advantageously an abrasion resistance measured by the ASTM-D4060 abrasion test of less than 0.5 g, advantageously less than 0.2 g, preferably less than 0.1 g, most preferably less than 0.01 g or even lesser.

The face of the layer adapted to contact the toner particles has also advantageously one or more characteristics selected among the group consisting of flexural modulus of $10^8$ Pa or less (flexibility of the strip under tortional strain), a storage modulus of $10^8$ Pa or less (i.e. a sufficient rigidity of the strip under tension), a Shore A hardness of less than 105, a Hoffman scratch-hardness test result of 2 or less (an abrasion resistance), and a color shift, in accordance with heat aging test ASTM D2244-79, within 1 delta E.

When using a strip to be attached on a substrate of a doctor blade, the strip is advantageously a multilayered strip.

The strip is for example a strip prepared in accordance to U.S. Pat. No. 5,089,330, the content of which is incorporated to said specification.

The invention relates also to the use of a toner cartridge with the magnetic roller and/or the doctor blade with a lanthanide containing layer in a printer, copier, fax, laser printer, etc. and a printing process using such a toner cartridge.

As typical lanthanide compounds, the following compounds given as examples only can be used:

Ce (metal), Pr (metal), Nd (metal), Pm (metal), mixtures of these metals, mischmetal, cerium oxide, cerium carbide, cerium hydroxide, cerium carbonate, neodium oxide, neodium carbide, praseodymium oxide, praseodymium carbide, praseodymium carbonate, and mixtures thereof.

These compounds, especially Cerium oxide particles with a size comprised between 0.1 μm and 20 μm, are abrasive and increase the triboelectric charge, whereby the life time of the doctor blade with a lanthanide containing layer and/or coating and/or strip is increased and whereby the transfer of toner particles on the magnetic roller is improved due to the increase of triboelectric charge by friction.

Details and characteristics of the invention will appear from the following description, in which reference is made to the attached drawings.

DESCRIPTION OF PREFERRED EMBODIMENTS

Figure 1:
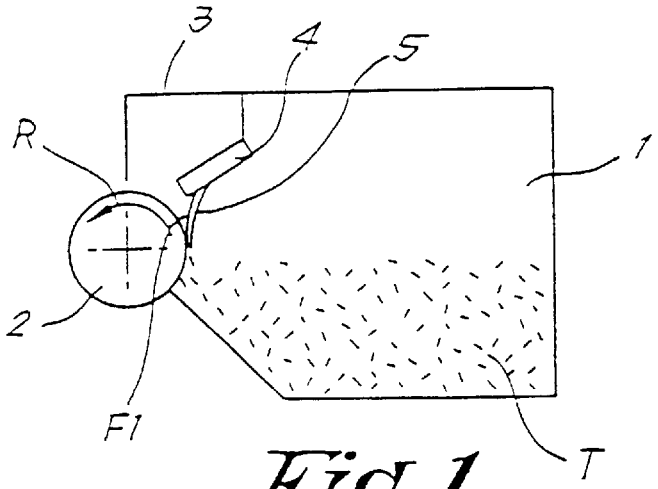
FIG. 1 is a schematic view of a first toner cartridge assembly.

The toner cartridge assembly of FIG. 1 comprises:

- a container 1 for containing toner particles T, said container being provided with an opening 1A;
- a magnetic roller 2 attached to the container 1 by means of arms 3, said roller being able to rotate (R) in front of the said opening 1A;
- a support 4 attached to the container 1;
- a flexible doctor blade 5 mounted on the support 4, the said doctor blade working with the magnetic roller, so as to obtain a correct distribution of toner particles on the magnetic roller, as well as a correct thickness of the layer of toner particles on the magnetic roller.

The doctor blade is not connected to a voltage supply means.

Figure 3:
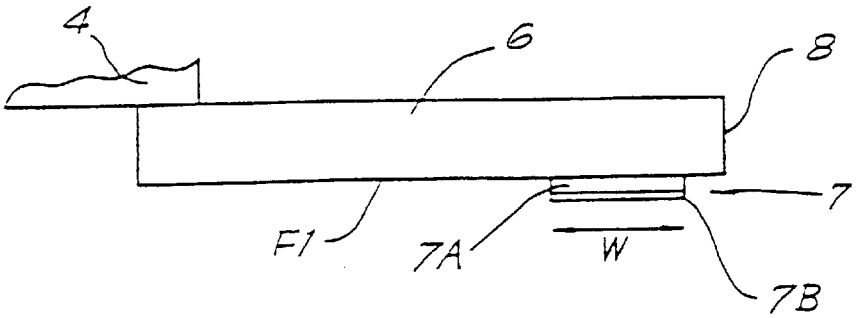
FIG. 3 is an enlarged cross-section view of the doctor blade of the toner assembly of FIG. 1.

FIG. 3 is an enlarged view of the doctor blade 5. Said doctor blade consists of a flexible substrate 6 (for example a polyurethane blade or a silicone blade), the face F1 intended to be directed towards the magnetic roller 2 being provided with a strip 7 comprising: a polyurethane layer 7A having a thickness of 250 μm and an electrical surface resistivity of more than $10^{14}$ Ω per square (more than 10 $10^{14}$ Ω per square), and a polyurethane layer or coating 7B having a thickness of 30 μm and an electrical surface resistivity of more than $10^{13}$ Ω per square and an abrasion resistance of less than 0.01 g (ASTM test-4060, 1000 cycli, load: 1000 g, abrader wheel CS10). The width W of the strip is advantageously comprised between 3 mm and 10 mm, for example 4–5 mm. The shore A resistance of the layer 7B is comprised between 97 and 94.

The electrical surface resistivity is advantageously measured in accordance to the ASTM method D 257-93.

The second layer 7B was water impermeable and had a resistance against abrasion measured by the ASTM-4060 abrasion test of less than 0.01 g. Said layer 7B was uniform (forming a continuous film with continuous and uniform characteristics) and had also friction characteristics so as to generate sufficient triboelectric charges by friction.

Said second layer is for example a polyurethane layer prepared as disclosed in U.S. Pat. No. 6,258,918, the content of which is incorporated by reference.

In case the first layer 7A has to be conductive, conductive expanded carbon black particles were added to the polyurethane, said carbon black particles having a diameter lower than 15 $\mu$m, a density of about 200 g/l (1 liter of carbon black powder weights 200 g), and a surface area (BET) of about 150 $m^2$/g.

The strip 7 is glued on the face F1 at a distance from the free end edge 8 of the flexible substrate 6. A groove or recess having a depth of about 280 $\mu$m (total thickness of the strip) is formed between the strip 7 and the free end 8 on the said face F1. When using such a doctor blade, toner particles fill at least partly said recess or groove, said toner particles forming a scraping protuberance ensuring a scraping action as well a protection against an accidental removal of the strip.

The doctor blade 5 is flexible and is bent when mounted in the toner cartridge assembly of FIG. 1. The doctor blade is therefore pressed towards the magnetic roller.

Figure 2:
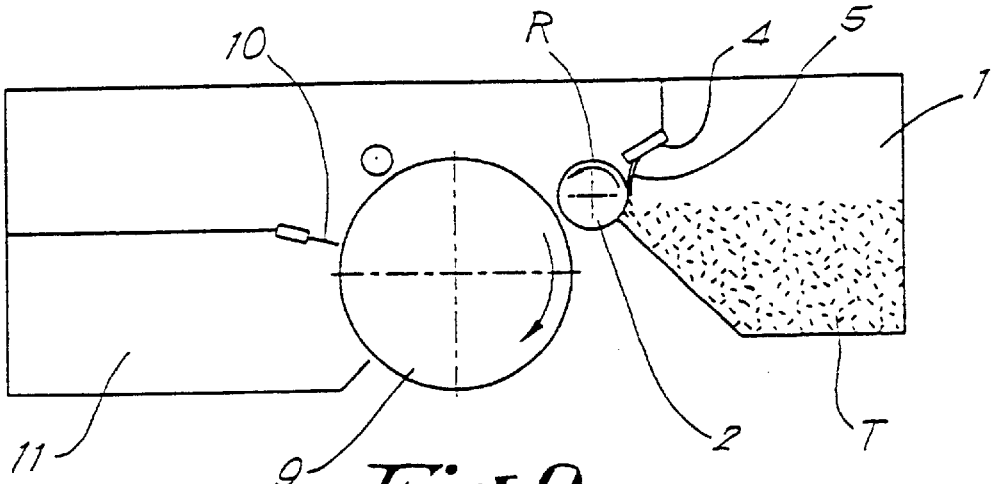
FIG. 2 is a schematic view of another toner cartridge assembly.

The toner cartridge assembly of FIG. 2 is similar to the toner assembly of FIG. 1, except that the toner assembly is further provided with a charge sensible drum 9 (such as a photo sensible drum), a scraper 10 for removing residual toner present on the drum 9 after the transfer of toner on a paper sheet, a container 11 for collecting the removed toner by the scraper 10, and a primary charge roller 12. The doctor blade used in this toner assembly was the same as for the toner assembly of FIG. 1. Possibly the scraper 10 can be provided with a flexible strip as defined for the doctor blade of the invention.

Tests have been carried out by using the toner assemblies of FIGS. 1 and 2 on copiers. These tests have shown that when using such a doctor blade, the quality of the copies is still excellent after more than 35,000 copies.

Figure 4:
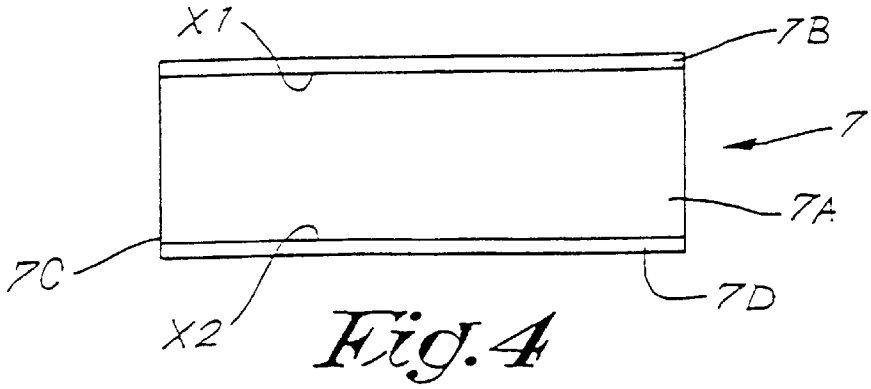
FIG. 4 is an enlarged cross-section view of a strip of the invention.

FIG. 4 shows a cross section view of a strip of the invention. Said strip 7 comprises:

- a polyurethane layer 7A having a thickness of 250 $\mu$m and an electrical surface resistivity of more than $10^{14}$ Ω a per square (such as more than 10 $10^{14}$ Ω per square),
- a polyurethane layer 7B having a thickness of 30 $\mu$m, an electrical surface resistivity of more than 1.5 $10^{12}$ Ω per square, and a resistance to abrasion of less than 0.01 g (preferably less than 0.005 g) (measured according to the method ASTM D4060), said layer 7B covering the face X1 of the layer 7A,
- a glue layer (preferably a self adhesive glue, but possibly a hot melt glue) 7C covering the face X2 (opposite to the face X1), and possibly
- a protective sheet 7D (such as a siliconized paper) intended to be removed before applying the strip on the doctor blade.

The polyurethane layers 7A, 7B can be prepared from a mixture containing a polyisocyanate and a polyol. When the layer 7A has to be conductive, conductive materials (such as conductive polymer, conductive particles, carbon black particles, etc.) are added to the mixture. The preparation of polyurethane films, bands or layers (conductive or not) can be made by using the methods disclosed in U.S. Pat. No. 3,933,548; No. 3,830,656; No. 5,855,820; EP 0 786 422 and/or EP 0 337 228, the content of which is incorporated herewith by reference. When the layer has to be non conductive, no conductive materials are added in the process of U.S. Pat. No. 3,933,548; No. 3,830,656; No. 5,855,820; EP 0 786 422.

Advantageously, the polyurethane is however a thermoplastic polyurethane

The polyurethane layer 7A can possibly be a foam layer.

The polyurethane layer 713 is preferably a layer as disclosed in U.S. Pat. No. 6,258,918 (with or without heat aging properties, especially with a color shift not in accordance with heat aging test ASTM D2244-79, within 1 delta E) or a layer prepared from an aqueous dispersion, such as an aqueous polyurethane dispersion.

FIGS. 5 to 11 are cross section views of strips of the invention.

Figure 5:
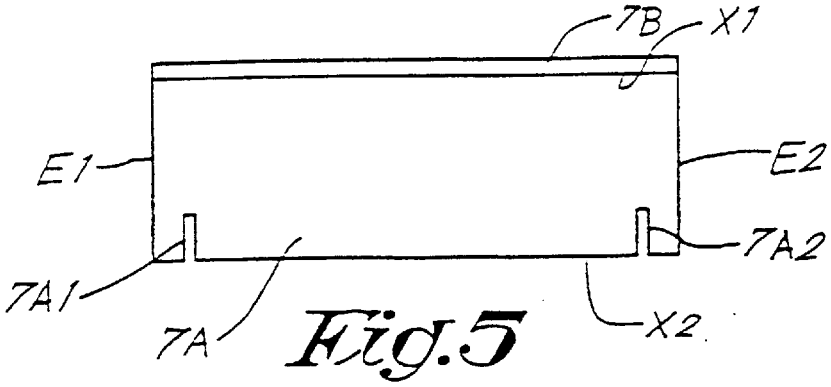
FIGS. 5 to 11 are views similar to that of FIG. 4, but of other embodiments of strips according to the invention.

The strip of FIG. 5 is similar to the strip of FIG. 4, except that the layer 7A is provided with longitudinal grooves 7A1, 7A2 extending along the face X2, so as to increase the flexibility of the strip along its longitudinal edges E1,E2.

Figure 6:
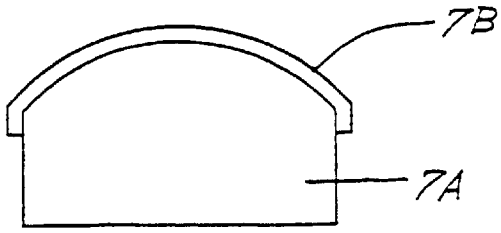
Figure 7:
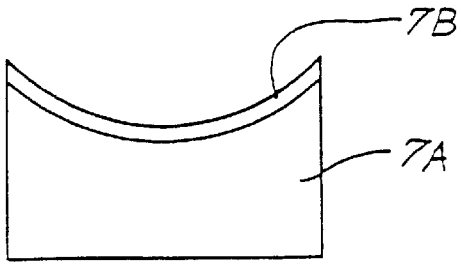

The strip 7 of FIG. 6 is similar to the strip of FIG. 4, except that the layer 7A has a convex cross section. In the strip of FIG. 7, the layer 7A has a concave cross section.

Figure 8:
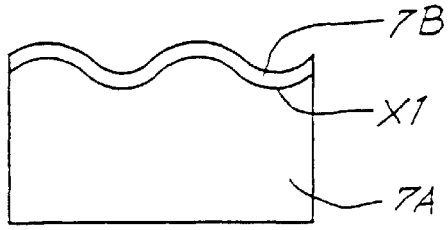

The strip of FIG. 8 has a layer 7A with a cross section with a wave shape along its face X1.

Figure 9:
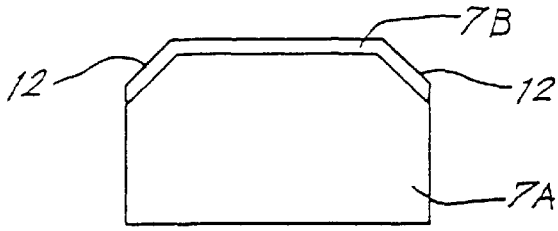

The strip of FIG. 9 has a cross section having inclined edges 12.

Figure 10:
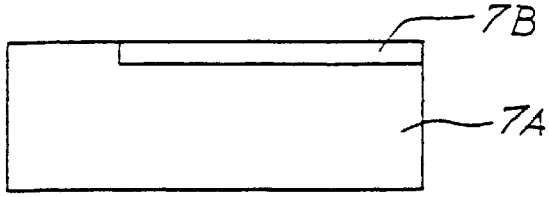
Figure 11:
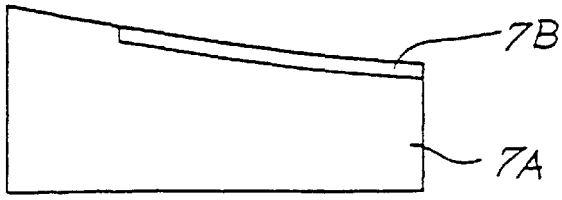

The strip of FIG. 10 has a substantially rectangular cross section, the layer 7B being located in a recess of the layer 7A. The strip of FIG. 11 is similar to the strip of FIG. 10, except that the thickness of the strip along the edge E1 is greater than the thickness along the edge E2. Advantageously the decrease of thickness from the edge E1 towards the edge E2 is continuous.

Figure 12:
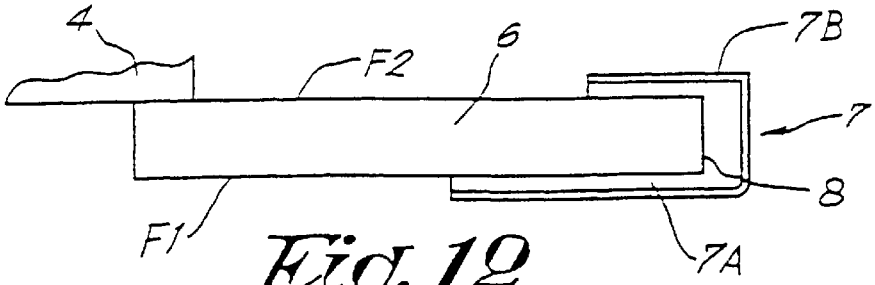
FIG. 12 is an enlarged cross-section of a specific embodiment of a doctor blade of the invention.

The doctor blade of FIG. 12 is similar to the doctor blade of FIG. 3, except that the strip 7 covers part of the face F1, the free end 8 and part of the face F2 of the substrate 6. This embodiment is advantageous, as there is no risk that the strip could be scratched away during its working and as the rigidity of the free end of the doctor blade is increased.

Figure 13:
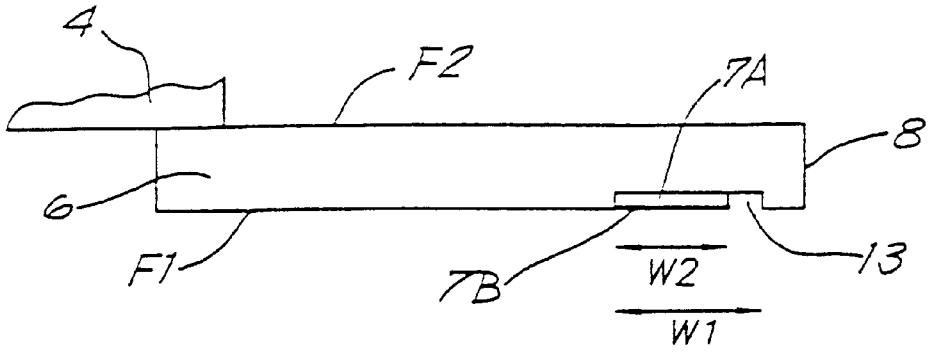
FIGS. 13 to 15 are enlarged cross-section views of still other embodiments of doctor blade.

The doctor blade of FIG. 13 comprises a substrate 6 provided with a longitudinal recess 13 in which a strip 7 is placed. Advantageously the recess 13 has a width w1 larger than the width w2 of the strip 6. Advantageously, the thickness of the strip 7 is greater than the depth of the recess, whereby the layer 7B is located below the face F1 when said face is horizontal and directed downwardly.

Figure 14:
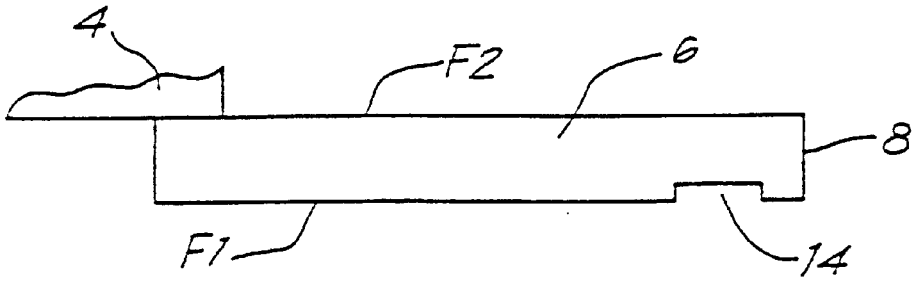

FIG. 14 is a cross section view of a flexible doctor blade made of polyurethane with a resistance to abrasion of less than 0.01 g (ASTM D4060). Said blade is further provided in the neighborhood of the free end 8, with a longitudinal groove or recess 14. Said groove or recess 14 is advantageously substantially parallel to the free end of the doctor blade. The width of the groove or recess is advantageously greater than 100 $\mu$m, preferably comprised between 200 $\mu$m and 3 mm, while the depth of the groove or recess is advantageously greater than 50 $\mu$m, preferably comprised between 100 $\mu$m and 1 mm. Preferably, the depth of the groove or recess is less than or equal to about 50% of the total thickness of the substrate 6 of the doctor blade 5.

The recess or groove is advantageously distant from the free end of the substrate. Advantageously, the recess or groove 14 is located at a distance greater than 500 $\mu$m, preferably comprised between 500 $\mu$m and 3 mm from the free end. The recess or groove is intended to be directed towards the magnetic roller. When using such a doctor blade in a toner cartridge assembly, toner particles fill the groove or recess and form a scraping means made of toner particles.

Instead of having a rectangular cross section, the groove or recess may have other cross-sections, such as semi circular, trapezoidal, triangular, etc. Advantageously, the groove or recess 14 extends between two substantially parallel edges e3,e4 on the face F1 of the substrate.

Figure 15:
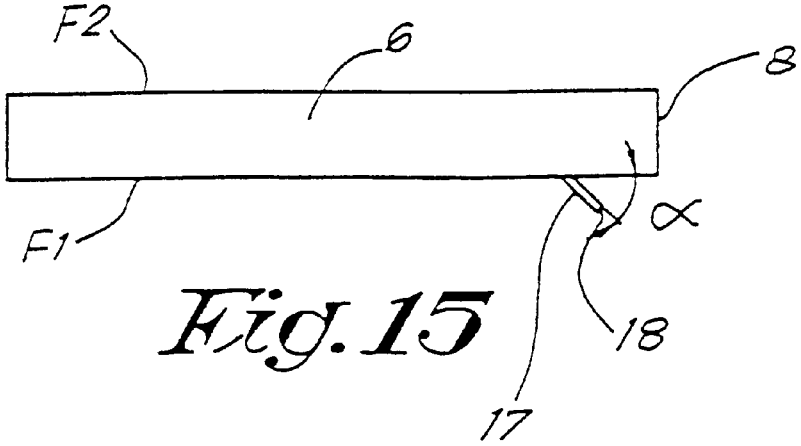

FIG. 15 shows in cross-section another embodiment of a doctor blade made of polyurethane with a resistance to abrasion of less than 0.01 g (ASTM D4060). In this embodiment, the recess or space 14 for receiving toner particles is formed by a longitudinal finger 17 present on the face F1 of the substrate 6, preferably in the neighborhood of the free end 8. The free end 18 of the said finger is advantageously distant form the face F1 of a distance of at least 200 $\mu$m, preferably of at least 500 $\mu$m (for example comprised between 500 $\mu$m and 3 mm). Such a finger 16 is advantageously inclined with respect to the face with an angle $\alpha$ comprised between 15 and 60°, so that the opening of the longitudinal space 14 is directed towards the end 8.

The finger 17 can be replaced by a strip fixed or glued on the face F1.

Figure 16:
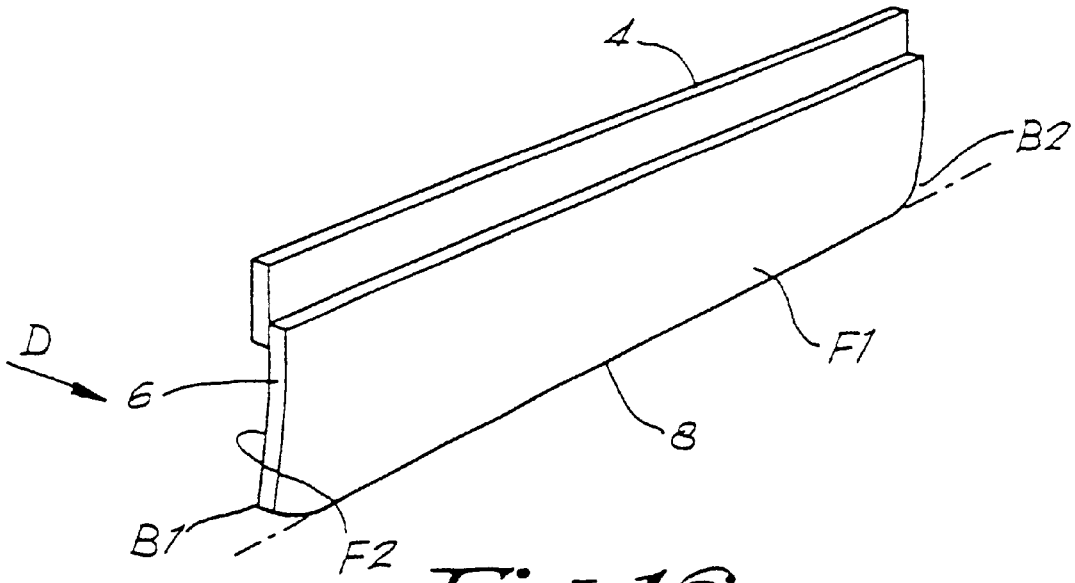
FIGS. 16 and 17 are views explaining the reconditioning of a doctor blade.
Figure 17:
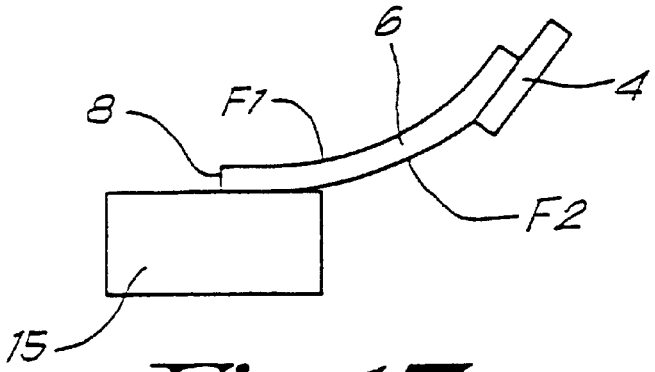

For reconditioning a doctor blade (for example made of polyurethane) showing a permanent bending B1,B2 (bending which is residual or due to the use of the doctor blade in a toner cartridge) along its lateral edges L1,L2 after a prolonged use, it has been observed that a heat treatment of the doctor blade combined with or followed by a bending in a direction D opposite to the direction of the permanent bending could restore the property of the face F1 of the substrate. This treatment is sufficient for obtaining back a substantially flat surface for the face F1 or a surface corresponding substantially to the surface of the substrate before use. For example, the said reconditioning is made by pushing the part of the face F2 of the substrate adjacent to the free end 8 on a heating element 15 so that the substrate 6 is bent in a direction opposite to the direction of the permanent bending, while being heated. The heating step is advantageously substantially sufficient for softening at least substantially the part(s) of the substrate having a permanent bending due to the use of the doctor blade. However, preferably, at least the part of the substrate 6 adjacent to the free end 8 is heated. (see FIGS. 16 and 17)

Figure 18:
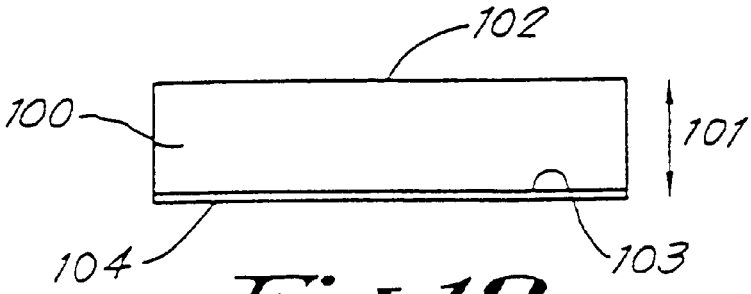
FIG. 18 is a further view of a strip according to the invention.

Advantageously, after the heat and bending treatments, a strip 7 of the invention is placed on the face F1 of the substrate. It is however also possible to first fix a strip 7 on the face F1 of the substrate, and then to apply the heat and bending treatments FIG. 18 is an enlarged view of a further embodiment of a strip of the invention. The strip 100 is a mono layer strip made essentially of elastic material (non conductive polyurethane) with an abrasion resistance of less than 0.01 g (ASTM D4060). The said layer has a thickness 101 of more than 100 $\mu$m, for example about 200 $\mu$m. The said layer has an electrical surface resistivity of about $10^{14}$ $\Omega$ per square.

As elastic material, polyurethane was used. However, other elastic material can be used, such as silicone, rubber, polyurethane or mixtures thereof possibly mixed with polyolefin or other polymer or copolymer.

The mono layer strip was impermeable to water and had an outer surface 102 intended to work with a magnetic roller, said surface having a resistance against abrasion measured by the ASTM-D4060 abrasion test of less than 0.01 g.

The said mono layer is advantageously provided on its face 103 to be applied on a substrate of the doctor blade with a glue layer 104.

Figure 19:
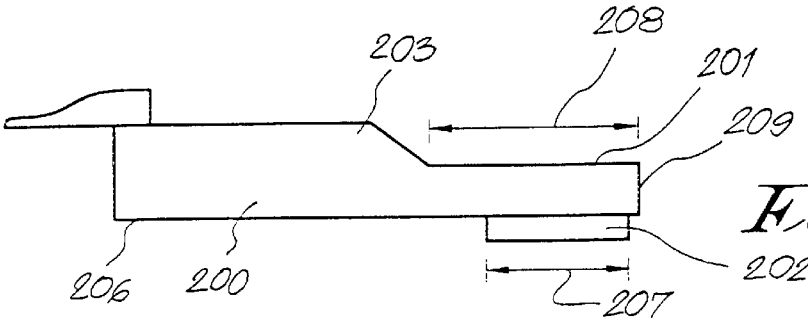
FIGS. 19 to 21 are further views of doctor blades of the invention.
Figure 20:
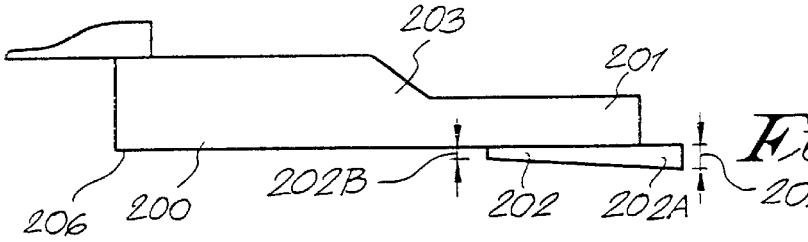
Figure 21:
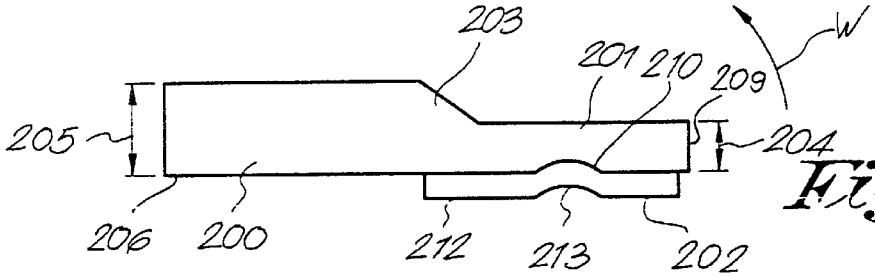

In FIGS. 19 to 21 (showing in cross section doctor blade), the doctor blade comprises a flexible substrate (such as a silicone substrate, a polyurethane substrate, . . . ) comprising a first portion 200 adapted to be attached to a support 210, a second portion 201 adapted for contacting with interposition of the strip 202 a magnetic roller, and an intermediate portion 203 connecting the first and second portions 200, 201, said intermediate portion defining a bending zone or line of the second portion 201 with respect to the first portion 200. The second portion has a thickness 204 lower than the thickness 205 of the first portion 200, whereby the second portion is more flexible than the first portion. The intermediate portion has a thickness varying from the thickness 205 in the neighborhood of the first portion to a thickness 204 in the neighborhood of the second portion 201. A face 206 of the substrate is substantially planar, the strip 202 being attached on said face 206. This substrate has a preferred bending in the direction of the arrow W.

In the embodiment of FIG. 19, the strip 202 is glued on the second portion of the substrate 201, the width 207 of said strip 202 being lower than the width 208 of said second portion 201. With respect to the free end 209 of the substrate, the strip 202 is distant from said free end of a distance, for example of at least about 20 $\mu$m, such as a distance comprised between 50 $\mu$m and 3 mm.

In the embodiment of FIG. 20, the strip 202 is glued on the second portion 201 and has a portion 202A extending outside the free edge 209, i.e. forming an extension of the doctor blade. The strip 202 has a thickness varying between a minimum thickness 202B and a maximum thickness 202C. The strip has a minimum thickness along its edge directed or adjacent to the connecting portion 203, while the portion of the strip 202 forming a prolongation of the portion 201 has a maximum thickness (for example along its free end edge).

In the embodiment of FIG. 21, the strip 202 is glued on the portion 201 of the doctor blade which has already been used. Said portion has a groove 210 which has been formed by the abrasion due to the contact of the portion 201 with the magnetic roller. The strip 202 is placed on the face 206 so as to cover completely said groove 210. As the strip is highly flexible, a slight depression or groove 213 can be formed at the face 212 of the strip 202.

When recycling a doctor blade which has already been used, it is preferred to restore the shape of the doctor blade, such a shape-restoration can be made by heating the blade and by applying a pressure on the blade (for example between two planar plates).

Figure 22A:
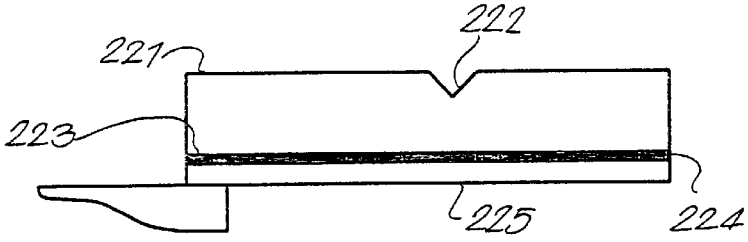
FIGS. 22A and 22B are cross section view and longitudinal front view of a strip.
Figure 22B:
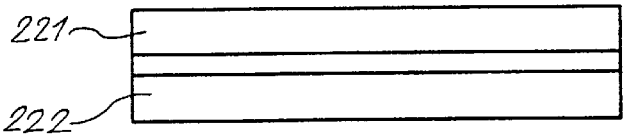

FIGS. 22A and 22B are views (cross section and longitudinal) of an embodiment of a strip suitable for a doctor blade. The strip 220 is provided on its top face 221 with a longitudinal groove 222. The opposite face 223 of the strip is provided with a glue layer or an adhesive layer 224, which can be protected by a removable film (such as a siliconized paper) 225.

Figure 23:
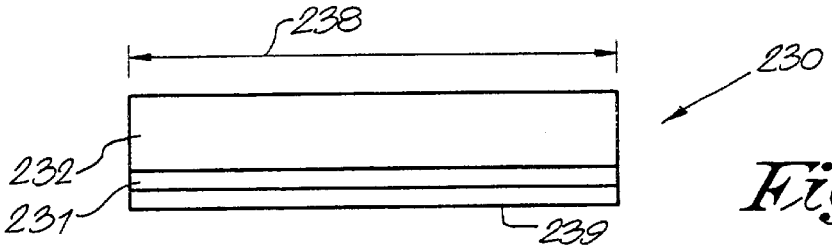
FIGS. 23 to 25 are front, back and cross-section views of a doctor blade of the invention.
Figure 24:
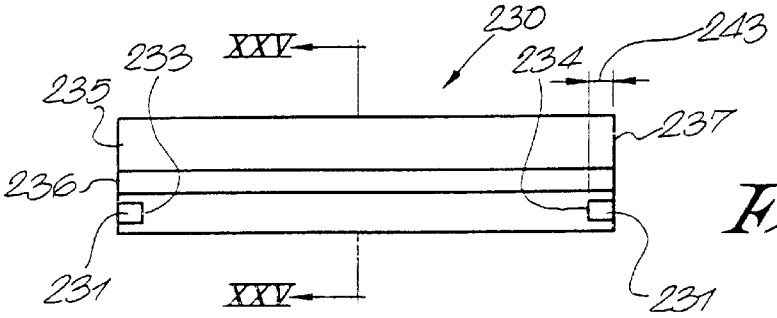

FIGS. 23 and 24 are front and back views of a doctor blade 230 provided with a strip 231. The strip 231 covers a longitudinal band of the front face 232 of the doctor blade, while the free ends 233,234 of the strip are folded on the back face 235 of the doctor blade, so as to increase the bending resistance of the lateral edges 236,237 of the doctor blade. In this embodiment, the length of the strip 231 is higher than the length 238 of the blade along its free edge 239.

In the embodiment of FIG. 23, the strip 231 is distant from the free edge 239. However, it is obvious that possibly said distance between the strip and the free edge can be equal to about 0.

The bent or folded portions of the strip have for example a length 243 of less than 3 cm, advantageously less than 2 cm, preferably less than 1 cm, so as to increase the bending resistance at the level of the lateral edges 236,237.

Figure 25:
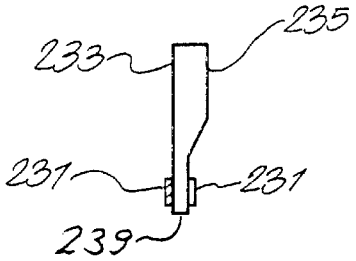
Figure 26:
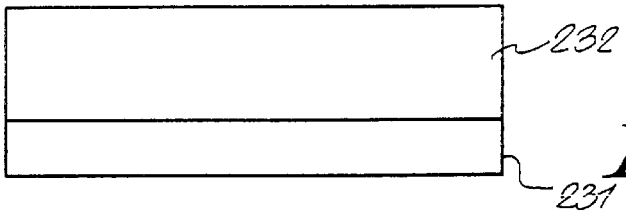
FIGS. 26 to 28 are front, back and cross-section views of another doctor blade of the invention.
Figure 27:
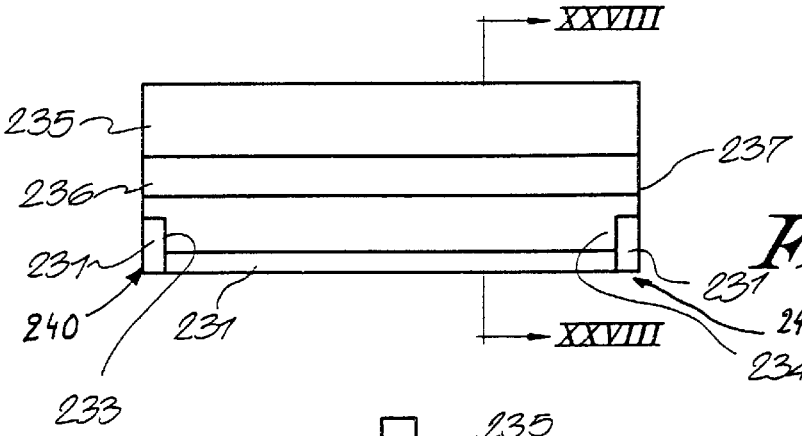
Figure 28:
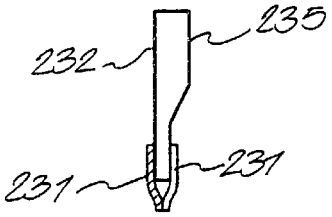

FIGS. 26 to 28 are views similar to the view of FIGS. 23 to 25, except that the strip extends partly outside the doctor blade along the free edge 239 (so as to form an extension or prolongation). The free ends 233,234 of the strip are folded towards the back face 235, whereby along the lateral edges 236,237 of the blade, the strip has portions 240,241 contacting each other, so as to increase the resistance of bending of the blade along the lateral edges 236,237.

Figure 29:
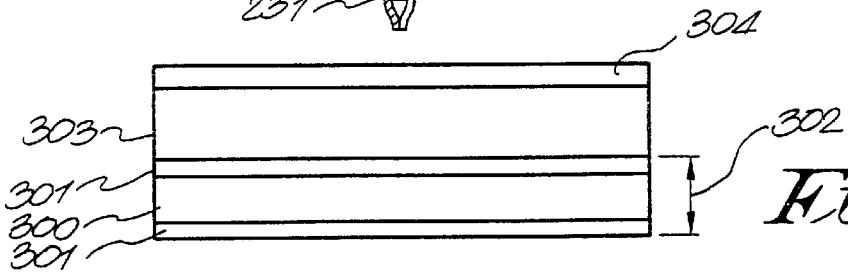
FIG. 29 is a cross section view of a strip suitable for the manufacture of a doctor blade of the invention.

FIG. 29 is a cross-section view of a strip suitable for the preparation of a doctor blade of the invention, such as a doctor blade as shown in FIG. 3, FIG. 12, FIGS. 19 to 28.

Said strip comprises:

- a film 300 (possibly porous or forming a network) provided on its both opposite faces with an acrylic adhesive composition 301, the total thickness 302 of the film+adhesive layers 301 being about 125 μm, while the thickness of one adhesive layer is about 30–50 μm;
- a polyurethane layer 303 with a thickness of about 100 μm, and
- a top coating polyurethane layer 304 with a thickness of about 10 μm, said top coat having preferably an abrasion resistance of less than 0.01 g as measured by the test ASTM D4060.

In further examples, the second layer 7B of the embodiments of FIGS. 3 to 13 was replaced by a layer containing 1 up to 5% by weight cerium oxide (particle size comprised between 0.1 μm and 1 μm).

In still further examples, the strip of the embodiments of FIGS. 19 to 29 is a strip provided with a layer contacting toner particles, said layer containing 1 up to 5% by weight cerium oxide (particle size comprised between 0.1 μm and 1 μm).

What I claim is:

1. A doctor blade comprising at least a flexible element with an outer face, a portion of said outer face being adapted for contacting with interposition of toner particles a magnetic roller of a machine selected from the group consisting of copier, printer and facsimile machine, in which said portion is provided with a coating having an abrasion resistance measured by the ASTM-D4060 (1 kg load, 1000 cycli, abrader wheel CS10) abrasion test of less than 0.5 g.

2. The doctor blade of claim 1, in which said portion is provided with a coating having an abrasion resistance measured by the ASTM-D4060 abrasion test of less than 0.2 g.

3. A doctor blade comprising at least a flexible substrate provided with a strip having a top face, a portion of which is adapted for contacting with interposition of toner particles a magnetic roller of a machine selected from the group consisting of copier, printer and facsimile machine, in which said portion has an uniform density and has an abrasion resistance measured by the ASTM-D4060 abrasion test of less than 0.2 g.

4. The doctor blade of claim 3, in which the strip has a thickness of at least 75 μm measured at the level of the portion contacting the magnetic roller with interposition of toner particles.

5. The doctor blade of claim 3, in which the strip has a thickness of at least 100 μm measured at the level of the portion contacting the magnetic roller with interposition of toner particles.

6. The doctor blade of claim 3, in which the strip has a thickness comprised between 200 μm and 2 mm measured at the level of the portion contacting the magnetic roller with interposition of toner particles.

7. The doctor blade of claim 3, in which at least the portion of the strip contacting the magnetic roller with interposition of toner particles has a surface resistivity of more than $10^2$ ohms per square.

8. The doctor blade of claim 3, in which at least the portion of the strip contacting the magnetic roller with interposition of toner particles has a surface resistivity of more than $10^7$ ohms per square.

9. The doctor blade of claim 3, in which at least the portion of the strip contacting the magnetic roller with interposition of toner particles has a surface resistivity of more than 1.5 $10^{12}$ ohms per square.

10. The doctor blade of claim 3, in which at least the portion of the strip contacting the magnetic roller with interposition of toner particles has a surface resistivity of more than $10^{13}$ ohms per square.

11. The doctor blade of claim 3, in which the portion of the strip contacting the magnetic roller with interposition of toner particles has an abrasion resistance measured by the ASTM-D4060 abrasion test of less than 0.2 g.

12. The doctor blade of claim 3, in which the strip is at least partly made of elastomer material.

13. The doctor blade of claim 3, in which the strip is at least partly made of elastomer material selected among the group consisting of polyurethane, rubber, silicone, fluoropolymers or copolymers, polyacrylate, polymethacrylate, copolymer of acrylic and methacrylic acids, polyolefins, polypropylene, polyethylene and mixtures thereof.

14. The doctor blade of claim 3, in which the substrate is a substrate made at least partly of a material selected from the group consisting of polyurethane, silicone, polyester, metallic blade, PVC, polycarbonate, fluoropolymers or copolymers, polyacrylate, polymethacrylate, copolymer of acrylic and methacrylic acids, polyolefins, polypropylene, polyethylene and mixtures thereof, said flexible strip being attached to said substrate.

15. The doctor blade of claim 3, in which the flexible substrate has a free end edge, said free end edge being at least partly covered by said strip.

16. The doctor blade of claim 3, in which the strip is glued on the flexible substrate.

17. The doctor blade of claim 3, in which the strip has a first portion covering at least a part of the substrate and a second portion forming an extension of the substrate from its free end edge.

18. The doctor blade of claim 3, in which the strip has a Shore A hardness of less than 105.

19. The doctor blade of claim 3, in which the strip has a Shore A hardness of less than 100.

20. The doctor blade of claim 3, in which the strip has at least one characteristic selected in the group consisting of flexural modulus of $10^8$ Pascals or less, a storage modulus of $10^8$ Pascals or less, a Shore A hardness of less than 100, a Hoffman scratch-hardness test result of 2 or less, and a color shift, in accordance with heat aging test ASTM D2244-79, within 1 delta E.

21. The doctor blade of claim 3, in which the flexible substrate is provided with a longitudinal means for facilitating its bending in a direction with respect to the opposite direction.

22. The doctor blade of claim 3, in which the flexible substrate comprises a first portion adapted to be connected to a support, a second portion with a free end edge and adapted to contact the developer roller with interposition of the strip, and an intermediate bending portion connecting the first and second portions, in which the strip is attached to the substrate so as to not cover the bending portion.

23. The doctor blade of claim 3, in which the strip comprises a layer attached to a double coated element, said doubled coated element having a thickness comprised between 20 and 200 μm.

24. The doctor blade of claim 3, in which the substrate has a free end edge and in that the strip is distant from said free edge of a distance comprised between 25 μm and 2 mm.

25. The doctor blade of claim 3, in which the strip has a substantially rectangular shape with a variable thickness along its width.

26. The doctor blade of claim 25, in which the strip has a first thickness along an edge adjacent to the free edge of the substrate and a second thickness for a portion distant from said edge, said second thickness being lower than the first thickness.

27. The doctor blade of claim 3, in which the strip is provided with a coating intended to contact the magnetic roller with interposition of toner particles, said coating having an uniform density and an abrasion resistance of less than 0.2 g, resistance measured according to the ASTM-D4060 abrasion test.

28. The doctor blade of claim 27, in which the coating is a flexible coating.

29. A toner assembly for a copier, printer or facsimile machine comprising at least:

a container for containing toner;

a magnetic roller; and a doctor blade working with the magnetic roller, the said toner assembly having the improvement that the doctor blade comprises at least a flexible element with an outer face, a portion of said outer face contacting with interposition of toner particles the magnetic roller, in which said portion is provided with a coating having an abrasion resistance measured by the ASTM-D4060 abrasion test of less than 0.5 g.

30. The toner assembly of claim 29, in which said portion of the doctor blade has a coating with an abrasion resistance measured by the ASTM-D4060 abrasion test of less than 0.5 g.

31. A toner assembly for a copier, printer or facsimile machine comprising at least:

a container for containing toner;

a magnetic roller; and doctor blade working with the magnetic roller, the said toner assembly having the improvement that the doctor blade comprises at least a flexible substrate provided with a strip having a top face, a portion of which is adapted for contacting with interposition of toner particles a magnetic roller of a machine selected from the group consisting of copier, printer and facsimile machine, in which said portion has an abrasion resistance measured by the ASTM-D4060 abrasion test of less than 0.5 g.

32. The process of claim 31, in which the flexible strip has a thickness of at least 75 $\mu$m measured at the level of the portion contacting the magnetic roller with interposition of toner particles.

33. The toner assembly of claim 31, in which the doctor blade is not provided with electrical connecting means for connecting it to a voltage supplying means.

34. The toner assembly of claim 31, in which the flexible strip has a thickness for its portion contacting the developer roller comprised between 200 $\mu$m and 3 mm.

35. The toner assembly of claim 31, in which the top layer has a resistance against abrasion measured by the ASTM-D4060 abrasion test of less than 0.5 g.

36. The toner assembly of claim 31, in which the doctor blade consists of at least a substrate having a free end edge and is provided with the strip having a face contacting the magnetic roller with interposition of toner particles, and in which the strip is distant from said free end edge of the substrate of a distance of at least 50 $\mu$m.

37. In a process for printing or copying a document by means of a printer, copier or facsimile machine, in which at least:

toner is transferred on a magnetic roller;

a doctor blade contacts said magnetic roller with interposition of toner particles for distributing toner on the magnetic roller;

toner distributed by the doctor blade of the magnetic roller is transferred on a charge sensible element; and toner transferred on the charge sensible element is transferred on a support, said process having the improvement that the doctor blade comprises at least an element with an outer face, a portion of said outer face being provided with a coating contacting with interposition of toner particles the magnetic roller, in which said coating has an abrasion resistance measured by the ASTM-D4060 abrasion test of less than 0.5 g.

38. The process of claim 36, in which said coating has an abrasion resistance measured by the ASTM-D4060 abrasion test of less than 0.2 g.

39. In a process for printing or copying a document by means of a printer, copier or facsimile machine, in which at least:

toner is transferred on a magnetic roller;

a doctor blade having a free end edge contacts said magnetic roller with interposition of toner particles for distributing toner on the magnetic roller;

toner distributed by the doctor blade of the magnetic roller is transferred on a charge sensible element; and toner transferred on the charge sensible element is transferred on a support, said process having the improvement that the doctor blade comprises at least a flexible substrate provided with a strip having a top face, a portion of which is adapted for contacting with interposition of toner particles a magnetic roller of a machine selected from the group consisting of copier, printer and facsimile machine, in which said portion has an uniform density and has an abrasion resistance measured by the ASTM-D4060 abrasion test of less than 0.5 g.

40. The process of claim 39, in which the strip has a thickness of at least 75 $\mu$m measured at the level of the portion contacting the magnetic roller with interposition of toner particles.

41. The process of claim 39, in which the doctor blade is not provided with electrical connecting means for connecting it to a voltage supplying means.

42. The process of claim 39, in which the strip has a thickness for its portion contacting the developer roller comprised between 200 $\mu$m and 3 mm.

43. The process of claim 39, in which the strip is provided with a top layer having a resistance against abrasion measured by the ASTM-D4060 abrasion test of less than 0.5 g.

44. The process of claim 39, in which the strip is a flexible strip.

45. A process for reconditioning a doctor blade of a printer, copier or facsimile machine, said doctor blade having a flexible substrate, in which, prior to the gluing of a strip with an uniform face having a resistance against abrasion measured by the ASTM-D4060 abrasion test of less than 0.5 g on the substrate of the doctor blade, the substrate having a shape distorted during a prior use thereof is submitted to a heat treatment and to a pressure for restoring substantially the shape of the substrate of the doctor blade before its use.

46. A process for reconditioning a doctor blade of a printer, copier or facsimile machine, said doctor blade having a flexible substrate, in which, prior to coating the flexible substrate with a coating having a resistance against abrasion measured by the ASTM-D4060 abrasion test of less than 0.5 g on the substrate of the doctor blade, the substrate having a shape distorted during a prior use thereof is submitted to a heat treatment and to a pressure for restoring substantially the shape of the substrate of the doctor blade before its use.

47. A process for reconditioning a doctor blade of a printer, copier or facsimile machine, said doctor blade having a flexible substrate, in which, after gluing of a strip with an uniform face having a resistance against abrasion measured by the ASTM-D4060 abrasion test of less than 0.5 g on the substrate of the doctor blade, the substrate having a shape distorted during a prior use thereof is submitted to a heat treatment and to a pressure for restoring substantially the shape of the substrate of the doctor blade before its use.

48. A process for reconditioning a doctor blade of a printer, copier or facsimile machine, said doctor blade having a flexible substrate, in which, after coating the substrate with a coating having a resistance against abrasion measured by the ASTM-D4060 abrasion test of less than 0.5 g on the substrate of the doctor blade, the substrate having a shape distorted during a prior use thereof is submitted to a heat treatment and to a pressure for restoring substantially the shape of the substrate of the doctor blade before its use.

49. A doctor blade comprising at least a flexible element with an outer face, a portion of said outer face being adapted for contacting with interposition of toner particles a magnetic roller of a machine selected from the group consisting of copier, printer and facsimile machine, said doctor blade having a front face intended to be directed towards the magnetic roller, a back face opposite to said front face and two lateral edges, and being associated with a strip covering at least a longitudinal portion of the front face and at least partly portions of the back face along the two lateral edges of the flexible element.

50. The doctor blade of claim 49, in which at least a portion of the strip has an abrasion resistance measured by the ASTM-D4060 abrasion test of less than 0.5 g.

51. The doctor blade of claim 50, in which said portion has an abrasion resistance measured by the ASTM-D4060 abrasion test of less than 0.2 g.

52. A doctor blade comprising at least a flexible substrate provided with a strip having a top face, a portion of which is adapted for contacting with interposition of toner particles a magnetic roller of a machine selected from the group consisting of copier, printer and facsimile machine, in which said strip comprises a layer assembly with a first face adapted for contacting the magnetic roller and with a second face opposite to said first face, and a flexible element coated on its opposite faces with an adhesive, whereby one adhesive face of the element is attached to the second face of the layer assembly, while the other face of the element is attached to the flexible substrate by the adhesive.

53. The doctor blade of claim 52, in which the flexible element is a film and in which the flexible film provided with adhesive on its both opposite faces has a thickness comprised between 20 $\mu$m and 200 $\mu$m.

54. The doctor blade of claim 52, in which the adhesive is an adhesive of the acrylic or methacrylic family.

55. A doctor blade comprising at least a flexible element with an outer face, a portion of said outer face being adapted for contacting with interposition of toner particles a magnetic roller of a machine selected from the group consisting of copier, printer and facsimile machine, in which said portion has a layer adapted for contacting toner particles, said layer containing at least a compound of the group consisting of the lanthanides, lanthanide containing compounds and their mixtures.

56. A magnetic roller of a machine selected from the group consisting of copier, printer and facsimile machine, said roller being adapted to contact with interposition of toner particles a doctor blade comprising at least a flexible element with an outer face, in which the magnetic roller is provided with a layer containing at least a compound of the group consisting of the lanthanides, lanthanide containing compounds and their mixtures.

57. The magnetic roller of claim 56, in which said layer comprises cerium oxide particles.

58. A doctor blade comprising at least a flexible substrate provided with a strip or coating having a top face, a portion of which is adapted for contacting with interposition of toner particles a magnetic roller of a machine selected from the group consisting of copier, printer and facsimile machine, in which said portion has a layer adapted for contacting toner particles, said layer containing at least a compound of the group consisting of the lanthanides, lanthanide containing compounds and their mixtures.

59. The doctor blade of claim 58, in which the flexible strip has a thickness of at least 75 $\mu$m measured at the level of the portion contacting the magnetic roller with interposition of toner particles.

60. In a process for printing or copying a document by means of a printer, copier or facsimile machine, in which at least:

toner is transferred on a magnetic roller;

a doctor blade having a free end edge contacts said magnetic roller with interposition of toner particles for distributing toner on the magnetic roller;

toner distributed by the doctor blade of the magnetic roller is transferred on a charge sensible element; and toner transferred on the charge sensible element is transferred on a support, said process having the improvement that the doctor blade comprises lanthanides or lanthanide containing compound.

61. In a process for printing or copying a document by means of a printer, copier or facsimile machine, in which at least:

toner is transferred on a magnetic roller;

a doctor blade having a free end edge contacts said magnetic roller with interposition of toner particles for distributing toner on the magnetic roller;

toner distributed by the doctor blade of the magnetic roller is transferred on a charge sensible element; and toner transferred on the charge sensible element is transferred on a support, said process having the improvement that the magnetic roller has a layer contacting toner particles, said layer comprising lanthanides or lanthanide containing compound.

62. A doctor blade comprising at least a flexible substrate provided with a strip having a top face, a portion of which is adapted for contacting with interposition of toner particles a magnetic roller of a machine selected from the group consisting of copier, printer and facsimile machine, in which said strip comprises (a) a layer assembly with a first face adapted for contacting the magnetic roller and with a second face opposite to said first face, and (b) a flexible element coated on its opposite faces with an adhesive, whereby one adhesive face of the element is attached to the second face of the layer assembly, while the other face of the element is attached to the flexible substrate by the adhesive, in which the first face of the layer assembly has an abrasion resistance measured by the ASTM-D4060 abrasion test of less than 0.5.

63. A doctor blade comprising at least a flexible element with an outer face, a portion of said outer face being adapted for contacting with interposition of toner particles a magnetic roller of a machine selected from the group consisting of copier, printer and facsimile machine, in which said portion has a layer adapted for contacting toner particles, said layer containing at least a compound of the group consisting of the lanthanides, lanthanide containing compounds and their mixtures, in which said lanthanide containing layer has an abrasion resistance measured by the ASTM-D4060 abrasion test of less than 0.5 g.

64. A doctor blade comprising at least a flexible element with an outer face, a portion of said outer face being adapted for contacting with interposition of toner particles a magnetic roller of a machine selected from the group consisting of copier, printer and facsimile machine, in which said portion has a layer adapted for contacting toner particles, said layer containing at least a compound of the group consisting of the lanthanides, lanthanide containing compounds and their mixtures, in which said portion has an abrasion resistance measured by the ASTM-D4060 abrasion test of less than 0.2 g.

65. A doctor blade comprising at least a flexible element with an outer face, a portion of said outer face being adapted for contacting with interposition of toner particles a magnetic roller of a machine selected from the group consisting of copier, printer and facsimile machine, in which said portion has a layer adapted for contacting toner particles, said layer containing at least a compound of the group consisting of the lanthanides, lanthanide containing compounds and their mixtures, in which said layer comprises cerium oxide particles.

66. A magnetic roller of a machine selected from the group consisting of copier, printer and facsimile machine, said roller being adapted to contact with interposition of toner particles a doctor blade comprising at least a flexible element with an outer face, in which the magnetic roller is provided with a layer containing at least a compound of the group consisting of the lanthanides, lanthanide containing compounds and their mixtures, in which said lanthanide containing layer has an abrasion resistance measured by the ASTM-D4060 abrasion test of less than 0.5 g.

67. A magnetic roller of a machine selected from the group consisting of copier, printer and facsimile machine, said roller being adapted to contact with interposition of toner particles a doctor blade comprising at least a flexible element with an outer face, in which the magnetic roller is provided with a layer containing at least a compound of the group consisting of the lanthanides, lanthanide containing compounds and their mixtures, in which said portion has an abrasion resistance measured by the ASTM-D4060 abrasion test of less than 0.2 g.

68. A doctor blade comprising at least a flexible substrate provided with a strip or coating having a top face, a portion of which is adapted for contacting with interposition of toner particles a magnetic roller of a machine selected from the group consisting of copier, printer and facsimile machine, in which said portion has a layer adapted for contacting toner particles, said layer containing at least a compound of the group consisting of the lanthanides, lanthanide containing compounds and their mixtures, in which said lanthanide containing layer has an abrasion resistance measured by the ASTM-D4060 abrasion test of less than 0.5 g.

69. A doctor blade comprising at least a flexible substrate provided with a strip or coating having a top face, a portion of which is adapted for contacting with interposition of toner particles a magnetic roller of a machine selected from the group consisting of copier, printer and facsimile machine, in which said portion has a layer adapted for contacting toner particles, said layer containing at least a compound of the group consisting of the lanthanides, lanthanide containing compounds and their mixtures, in which said portion has an abrasion resistance measured by the ASTM-D4060 abrasion test of less than 0.2 g.

* * * * *